US010157517B2

(12) United States Patent
Grubmueller, Jr.

(10) Patent No.: US 10,157,517 B2
(45) Date of Patent: Dec. 18, 2018

(54) ROULETTE APPARATUS AND METHOD TO ENSURE UNAMBIGUOUS WHEEL POSITIONS

(71) Applicant: Walter Grubmueller, Jr., Vienna (AT)

(72) Inventor: Walter Grubmueller, Jr., Vienna (AT)

( * ) Notice: Subject to any disclaimer, the term of this patent is extended or adjusted under 35 U.S.C. 154(b) by 64 days.

(21) Appl. No.: 15/307,166

(22) PCT Filed: Jan. 22, 2015

(86) PCT No.: PCT/EP2015/051211

§ 371 (c)(1),
(2) Date: Oct. 27, 2016

(87) PCT Pub. No.: WO2015/165597

PCT Pub. Date: Nov. 5, 2015

(65) Prior Publication Data

US 2017/0221299 A1 Aug. 3, 2017

(30) Foreign Application Priority Data

Apr. 29, 2014 (EP) ..... 14166400

(51) Int. Cl.
*A63F 5/00* (2006.01)
*G07F 17/32* (2006.01)

(52) U.S. Cl.
CPC ..... *G07F 17/3213* (2013.01); *G07F 17/322* (2013.01); *A63F 5/00* (2013.01);
(Continued)

(58) Field of Classification Search
CPC ..... G07F 17/3213; A63F 5/00; A63F 5/0005; A63F 5/0011; A63F 5/0017; A63F 5/007; A63F 5/0076; A63F 5/0082; A63F 5/046
(Continued)

(56) References Cited

U.S. PATENT DOCUMENTS 5,636,838 A 6/1997 Caro
7,674,172 B2 * 3/2010 Miltenberger ..... A63F 5/00 273/142 E (Continued)

FOREIGN PATENT DOCUMENTS

EP 2 538 395 A1 12/2012

OTHER PUBLICATIONS

International Search Report dated Apr. 22, 2015 which issued in PCT Patent Application No. PCT/EP2015/051211.

*Primary Examiner* — Benjamin Layno
(74) *Attorney, Agent, or Firm* — Dickinson Wright PLLC

(57) ABSTRACT

A roulette apparatus (1) comprises at least one mechanical roulette wheel (2) with pockets (3) to receive a ball (4) and roulette-display-system (10) with graphical electronic display (11) surrounding the roulette wheel (2). The electronic display (11) comprises display fields (12) to display single betting numbers (N). A sensor unit (20), a drive unit (30) and a control system (40) are provided and the control system (40) is adapted to receive status information from the sensor unit (20) about the roulette wheel (2) and/or the ball (4) rested in one of the pockets (3) and cause the roulette wheel (2) based on the received status information to be adjusted in a unambiguous final position in relation to the display (11), wherein the pocket (3) with the ball (4) lies completely in congruence with the directly adjacent respective display field (11).

13 Claims, 2 Drawing Sheets

(52) U.S. Cl.
CPC ..... *A63F 5/0005* (2013.01); *A63F 5/007* (2013.01); *A63F 5/0011* (2013.01); *A63F 5/0017* (2013.01); *A63F 5/0076* (2013.01); *A63F 5/0082* (2013.01)

(58) Field of Classification Search
USPC ..... 273/142 E, 142 R, 142 H, 142 HA
See application file for complete search history.

(56) References Cited

U.S. PATENT DOCUMENTS

| | | | | |
|---|---|---|---|---|
| 7,708,630 | B2 * | 5/2010 | Nicely ..... | A63F 5/00 273/138.2 |
| 2007/0120320 | A1 | 5/2007 | Miltenberger et al. | |
| 2008/0214264 | A1 | 9/2008 | Griswold et al. | |

* cited by examiner

ROULETTE APPARATUS AND METHOD TO ENSURE UNAMBIGUOUS WHEEL POSITIONS

BACKGROUND OF THE INVENTION

The present invention relates to a method to ensure unambiguous wheel positions an apparatus thereto with a roulette wheel including a roulette-display-system. The present invention therefore relates in particular to roulette apparatus comprising a mechanical roulette wheel in connection to an electronic display system surrounding the roulette wheel, accompanying physical modifications and a specific control system and a method thereto.

Roulette and gaming apparatuses are well known in the art. A roulette gaming apparatus has provided entertainment and bets in casinos and other gaming establishments for many years.

Typically a circular roulette wheel is spun in either a clockwise or an anti-clockwise direction about its central axis. The wheel comprises a plurality of compartments to receive a ball. The compartments are typically numbered with numbers. A ball is released onto the surface of the wheel where it is randomly deflected before eventually coming to rest in one of the desired compartments, also called pockets in this description, where a player bet on.

Since players bet on a compartment or a group of compartments the ball is going to fall into by placing tokens or "chips" at appropriate locations on a betting table and e.g. a croupier may manually operate the wheel. These traditionally roulette game systems have been modified in different aspects, such as technical aspects and electronic technology.

In existing roulette apparatuses the wheel is surrounded by fixed (e.g. un-changeable) installed numbers and colors (typically red and black) and static printed on a surface indicating the position of the respective compartments of the roulette wheel when stopping in a gaming position after turning the wheel.

However, this systems does not allow to modify the game and to provide physical modifications for the respective game variation, such as e.g. derivative games. It is therefore desirable to provide a multifarious roulette apparatus with different possibilities to modify and control the game.

In the EP 14166400 A1 a roulette apparatus is provided which is a modification of the classic version of roulette, for instance a game wherein a number is knocked out after each spin, causing the bet odds to change, and the display to therefore change the count of numbers and describes a display system which enables the development of roulette based games with a variable number of numbers (results) surrounding the wheel.

However, problems of such an apparatus as described above may be caused by the fact that the betting results are not unambiguous. Since the number of ball pockets is still fixed on the mechanical revolving roulette wheel there may be undefined or unambiguous results, in particular when the number of ball pockets does not correspond with the number of possible results surrounding the wheel. When performing the game with an aforesaid mechanical roulette wheel wherein the number of pockets is different to the number of possible results presented by the surrounding display fields, the wheel with the ball may come to stop in one specific pocket position which is located between two possible results and therefor the result may be invalid. However, the result has to be clear and unambiguous. Therefore the stop position of the wheel with the pocket wherein the ball is rested has to be in a clear position within the corresponding display field.

Therefore an object of the present invention is to overcome the above-mentioned disadvantages and to provide a modifiable and multifarious roulette-system wherein the results are unambiguous.

The basic idea of the present invention is therefore to provide a device comprising a control system and an adjustment system for the roulette wheel (which shall not influence the result of the roulette game as such), but which is adapted for a specific adjustment of the final stop position of the wheel to achieve an unambiguous result.

According to an aspect of the present invention, a mechanical roulette wheel and a table is modified to incorporate a graphical display system, accompanying physical modifications and a specific control and adjustment system.

In a preferred embodiment of the invention the movement of the roulette wheel is controlled by a drive unit, such as a motor, in particular a servo motor or a stepper motor. However, the type of drive unit which is used to stimulate and control the turn of the wheel can be fit appropriate. It is preferred but not limited to such devices which may be used to stimulate the turn of the wheel, including—but not restricted to—electric, magnetic or inductive driven devices.

According to an advantageous embodiment of the present invention, a sensor system is provided to monitor and detect the status of the roulette wheel. Preferably a various number of sensors or an array of sensors is used to detect specific parameters of the wheel (such as e.g. the relative turning position of the wheel and the position of the ball(s) in the roulette bowl or in the wheel pockets and/or the speed of the wheel).

Therefore, the type of sensors to be used has to be capable to measure the relevant parameters of the wheel within a certain precision, including e.g. optical, magnetically, inductive or weight sensors.

One option to detect and/or monitor the position of the ball which is rest in a certain pocket is the use of an imaging monitoring device by taking images of the wheel during the whole process. Analyzing these images is to be understood e.g. by the use of optical sensors.

One further aspect of the mechanical part of the roulette system according to the present invention is the use of a drive actuator. The position of the drive actuator may be on top of the base plate or below the base plate of the wheel, connected to the wheel via an adjustment system, such as e.g. a transmission gear or any other adjustment or correction method (e.g. magnetically or mechanically).

According to another aspect of the present invention, an electronic control system for the wheel is provided. The control system is connected to the drive unit and the sensor system. The control system receives, preferably via I/O modules, information and respective parameters about the actual status of the wheel from the one or more sensors e.g. from the sensor array.

Furthermore, the control system is adapted to transmit commands to the drive unit and therefore to the wheel. Preferably, a connected computer (PC) based game controller sends commands to the wheel controller via an interface.

In this configuration, the control system transmits status information to the controller via the same interface. However, an alternative configuration of the communication between the control system, the drive unit and the sensor unit may be used.

The wheel controller receives information about the number of possible results and calculates all possible positions where the ball may be located at the final stop. When the wheel with the ball pockets is turning the controller knows the status of the ball and detects when the ball comes to a final rest in one of the wheels pockets.

In a further advantageous embodiment of the invention, the display system may be configured in at least three different configurations. Depending on the configuration of the display system the numbers on the display may be fixed on the table in relation to the table, spin with the wheel in the same turning direction of the wheel or spin in opposite direction of the wheel. Depending on the respective game configuration of the display, the wheel controller calculates the possible stop positions and/or the positions where the wheel is not allowed to stop. Based in this wheel status information, the control system may cause the drive unit to bring the wheel with the ball in the packet to a final (allowed) stop position. This final position is a position wherein the packet with the ball is stopped in a clear corresponding position within the display field. However, the correction measure will not influence the betting result as such only the correct unambiguous position of the wheel and the respective packet in regard to the display field.

DETAILED DESCRIPTION OF THE INVENTION

A more complete appreciation of the invention and many of the attendant advantages thereof will be readily obtained as the same becomes better understood by reference to the following detailed description when considered in connection with the accompanying drawings, wherein.

It will be appreciated by those of ordinary skill in the art that the invention can be embodied in other specific forms without departing from the spirit or essential character thereof. The presently disclosed embodiments are therefore considered in all respects to be illustrative and not restrictive.

Figure 1:
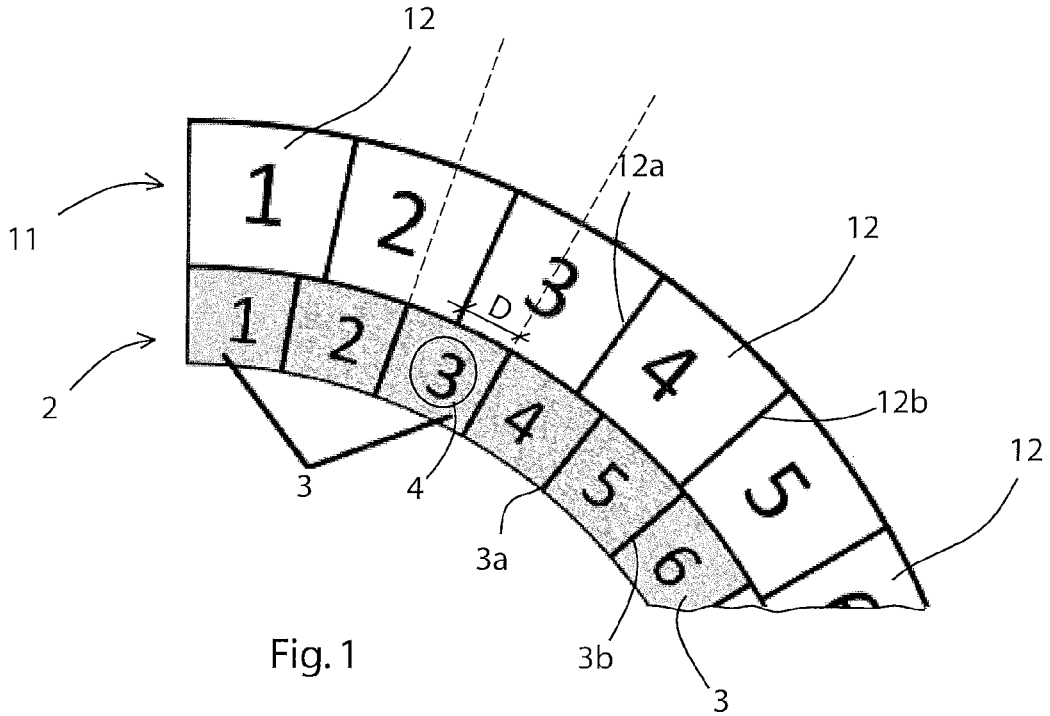
FIG. 1 is a schematic top view of a final position of a roulette wheel wherein the position of the pocket within the ball is not in accordance with the display field of the result number.

FIG. 1 is a schematic top view of a final position of an explanatory segment of a roulette wheel 2 surrounded by an electronic display 11. Preferably the number and/or the size and/or the form of the display fields 12 of the display 11 is adaptable and/or changeable according the proceeding of the game or a possible game modification of the running game.

Figure 3:
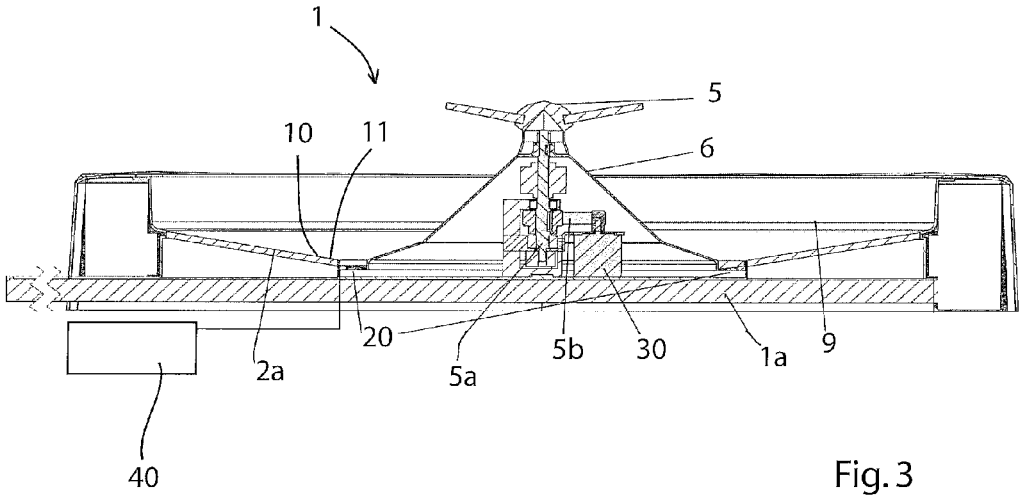
FIG. 3 is one explanatory embodiment of a mechanical roulette wheel connected to a wheel control system and FIG. 4 shows the basic configuration of an embodiment of a control system to adjust the final position of the mechanical wheel.

The detail shown in FIG. 1 is part of a roulette apparatus 1 according to FIG. 3. The roulette apparatus 1 comprising a graphical roulette-display-system 10 with a graphical display 11 to display numbers or changeable dynamic content relating to game information on at least one display field 12. The display 11 is divided in a number N of display fields 12, which are provided next to the ball track of the roulette wheel 2. In the present embodiment the size of the display fields shown on the 360 degree display surrounding the wheel 2 depends on the possible bet numbers of the game. According to this embodiment of a roulette apparatus, a game may be provided wherein a certain number is knocked out after each spin. Since the total numbers may be reduced hereby, the size has to be fitted to the remaining numbers. Nevertheless the pocket may stop at a position between two remaining numbers as long as no correction measure according to the present invention has been performed.

The roulette apparatus 1 includes the graphical display 11 whose contents may be digitally changed, unlike a static printed graphic. The display 11 may be implemented using any suitable technology such as LCD, LED, OLED, projection, deflection, laser, or any other method of dynamically displaying an image.

As can be seen in FIG. 1, the size of the display fields 12 is larger than the size of the packets 3. Depending on the remaining numbers (e.g. 30 in the present example) of display fields the size of the display fields 12 is increased, since less remaining numbers may remain available after a game has been performed.

Figure 2:
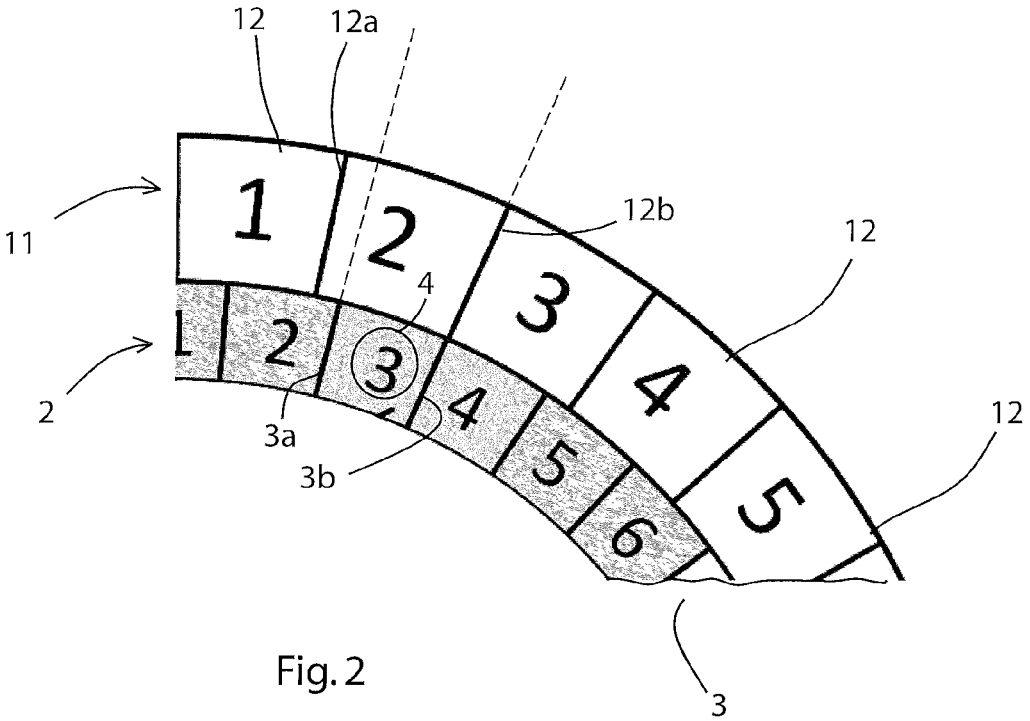
FIG. 2 is a schematic top view of a final position of a roulette wheel wherein the position of the pocket within the ball is in accordance with the display field of the result number.

However, according to FIG. 2, the definition of the correct and unambiguous position of the packet 3 of the roulette wheel 2 according to this invention means that the final position of the packet 3 with the rested ball 4 (shown here in transparency) lies in relation to the display 11 completely in congruence with the directly adjacent respective display field 11, such that bath side borders 3*a*, 3*b* in the circumferential direction of the pocket 3 lies (in their extension in the radial direction—shown as dotted lines) between the both side borders 12*a*, 12*b* defining the borders of the display field 12. As long as one of the side borders 3*a* or 3*b* of a packet 3 is in alignment with one of the correspondent side boarders 12*a* or 12*b* the position can be defined as "unambiguous" (see example in FIG. 2 for packet no. 3 and 4).

The pockets with the numbers 1 and 6 in FIG. 1 are also unambiguous positions in regard to the correspondent directly adjacent display fields 12 with the display field numbers 1 and 5. However, the pockets with the numbers 2, 3, 4 and 5 are not correctly positioned in congruence with the respectively adjacent display fields 12. At least one part of the pockets 3 with the numbers 2, 3, 4 and 5 does not overlap (in extension radially) with the directly adjacent display field 12. Would the ball 4 be rested in any of these pockets 3, the position would not be unambiguous and the came would therefore be invalid.

As described above, the present invention provides a control system, connected with the drive unit and the sensor unit to adjust the final position of the wheel depending on the pocket 3 in which the ball 4 is rested and the deviation which would occur without a correction measure.

Therefore the provided method to adjust the roulette wheel 2 of a roulette apparatus 1 comprises inter alias the following steps:

a. a sensor of the sensor unit 20 detects one or more physical characteristics and/or a status parameter and/or a position related parameter of the roulette wheel 2;
b. a sensor of the sensor unit 20 detects the position of the ball 4 (in the present example the pocket with the number 3) of the roulette wheel (2);
c. the control system 40 receives the information from the sensor unit 2 detected in step a) and b);
d. the control system 40 causes the roulette wheel 2 based on the received information to stop the roulette wheel 2 in a unambiguous calculated final position (see position of FIG. 2) in relation to the display field 11, which shows the result of the roulette bet (target display field), wherein the pocket with number 3 lies now adjacent in congruence with the respective target display field with the number 2.

The same situation is valid for the pocket with number 4 and the display field with number 3, if the ball would rest in this pocket.

The control system calculates after step b) the possible unambiguous stop positions of the wheel and/or the positions where the wheel is not allowed to stop because of unambiguousness between the position of the pocket 3 within the ball 4 and the directly adjacent display field.

The control system 40 manipulate the roulette wheel 2 in order to adjust the calculated stop position as shown in FIG. 1, since the calculated stop position for the pocket with the number 3 is deviated from the desired respective unambiguous stop position. The adjustment is made through a correction measure to bring the pocket with number 3 clearly in accordance with the display field 12 with the number 2, which has been calculated as the display field which is directly adjacent to the final position of the packet 3, when the ball would rest in this pocket. The correction measure corrects the final stop position in regard to the respective display field however not more than the calculated deviation D from this display field. Thus, the maximal correction is the deviation to the most adjacent display field (max. half of the length of the distance between the left border 3*a* and the right border 3*b* along the outer radial border 3*c* of the respective packet 3). However, in alternative configurations the control system may also perform the correction measure according to a specific deviation D. It would be possible to define the most overlapped part between the pockets and the adjacent display fields as the display field with the correct stop position or alternatively the deviation in the turning direction. The last option would lead to correction measures always to the next adjacent display field, so that the correction turn of the wheel would not be more than one field width.

The correction measure will be performed preferably by an adjustment unit, in particular by a respective deceleration or acceleration measure with a respective calculated deceleration or acceleration value. In the present example the wheel should be accelerated with a small correction value to ensure, that the wheel 2 will not stop in the position as shown in FIG. 1, but will stop when achieving the unambiguous position as shown in FIG. 2.

Figure 4:
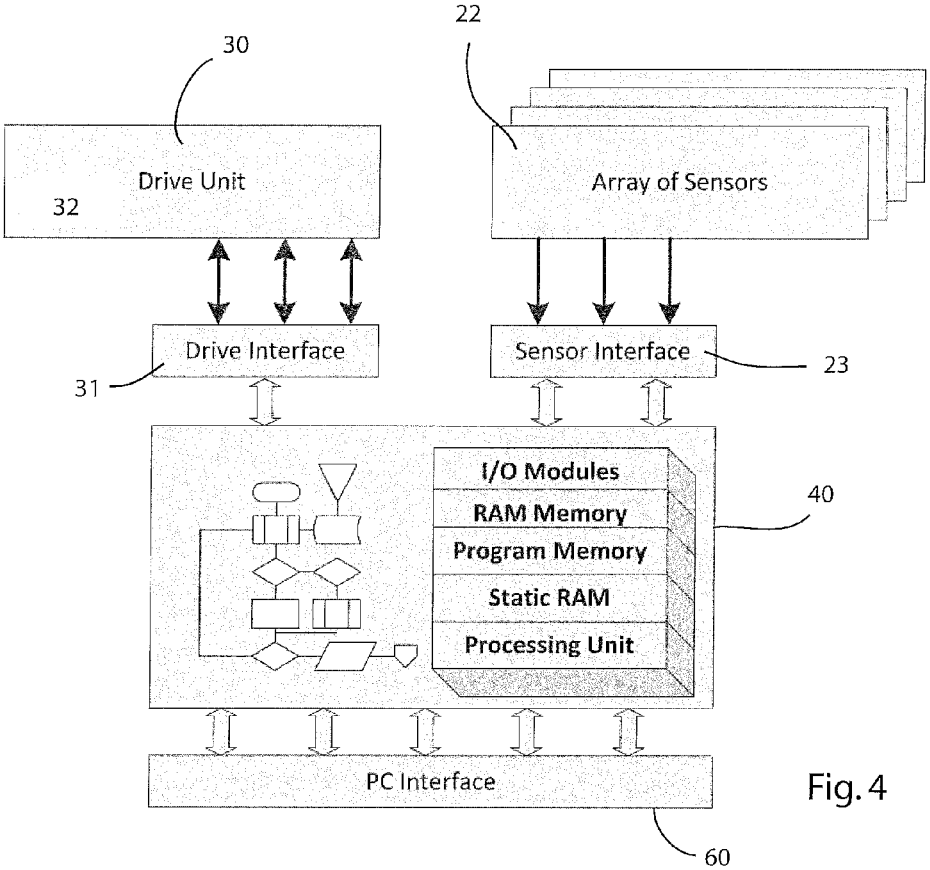

In the FIGS. 3 and 4, a roulette apparatus 1 is shown comprising a mechanical roulette wheel 2 with a number of pockets 3 to receive a ball 4 and a graphical roulette-display-system 10 with at least one graphical electronic display 11 surrounding the roulette wheel 2, wherein the electronic display 11 comprising a number of display fields 12 to display single betting numbers (N) and wherein a sensor unit 20, a drive unit 30 and a control system 40 are provided. It can also be seen that the roulette wheel 2 has a ball track 2*a*, a turret 5, a cone 6, a wheel spindle 5*a*, a transmission 5*b* and a base plate 9.

FIG. 4 shows a configuration of an embodiment of a control system 40 to adjust the final position of the mechanical wheel. The control system 40 is adapted to receive status information from the sensor unit 20 about the roulette wheel 2 and/or the ball 4 rested in one of the pockets 3. The control system 40 is connected via interfaces with the drive unit 20 and the array of sensors (sensor unit) 30. The sensor unit 20 is connected via a sensor interface 23 with the control system 40 to receive sensor data from the sensor unit 20.

The control system 40 comprises preferably I/O modules, RAM memory, program memory, static RAM and a processing unit. Moreover, the drive unit is established with an adjusting unit to produce the correction measure. A PC interface 60 is further provided and connected with the control system to connect a PC to the system.

The sensor unit 20 is formed by a number of sensors which define a sensor array 22 which is installed next to the ball track 2*a*. The drive unit 30 comprises an adjustment unit 32 which is connected via a drive unite interface 31 with the control system 40. The control system 40 may initiate (based on received and calculated values) the aforesaid correction measure to the roulette wheel 2 via the drive unit 20.

By extension of the above-mentioned modifications, other aspects of the roulette apparatus may be modified to achieve a more manifold apparatus. While particular embodiments have been chosen to illustrate the invention, it will be understood by those skilled in the art that various changes and modifications can be made therein without departing from the scope of the invention as defined in the appended claims. A non-limiting example thereof is the a roulette apparatus is configured that the numbers on the display fields 2 of the display 11 are fixed in relation to the roulette apparatus 1 or spin with the roulette wheel 2 in the same turning direction or in the opposite turning direction. Respectively the adjustment values have to be adapted to one of these configurations appropriately.

The invention claimed is:

1. A roulette apparatus (1) comprising at least one mechanical roulette wheel (2) with a number of pockets (3) to receive a ball (4) and an electrical roulette-display-system (10) with at least one graphical electronic display (11) surrounding the roulette wheel (2), wherein the electronic display (11) comprising a number of display fields (12) to display single betting numbers (N) and wherein a sensor unit (20), a drive unit (30) and a control system (40) are provided, wherein the drive unit (301 is adapted to rotate the roulette wheel (2), and wherein the control system (40) is adapted to receive status information from the sensor unit (20) about the roulette wheel (2) and/or the ball (4) rested in one of the pockets (3) and the control system (40) may cause the roulette wheel (2) based on the received status information to be adjusted via the drive unit (30) in an unambiguous final position in relation to the display (11), wherein the pocket (3) with the ball (4) lies completely in congruence with the directly adjacent respective display field on the electronic display (11) such that side borders (3*a*, 3*b*) of the pocket (3) are both between side borders (12*a*, 12*b*), defining one of the display fields (12).

2. A roulette apparatus (1) according to claim 1, wherein the sensor unit (20) is provided to detect physical characteristics and/or a status and/or a position or other measurable properties of the roulette wheel (2).

3. A roulette apparatus (1) according to claim 1, wherein the sensor unit (20) is provided to detect the pocket of the roulette wheel (2) wherein the ball is rested.

4. A roulette apparatus (1) according to claim 1, wherein the sensor unit (20) comprises a number of sensors (21) and/or a sensor array (22).

5. A roulette apparatus (1) according to claim 1, wherein the sensor unit (20) is connected via a sensor interface (23) with the control system (40) to receive sensor data from the sensor unit.

6. A roulette apparatus (1) according to claim 1, wherein the drive unit (30) is connected via a drive unit interface (31) with the control system (40).

7. A roulette apparatus (1) according to claim 1, wherein the drive unit (30) is provided with an adjustment unit, which may cause the roulette wheel to stop in a corrected position.

8. A roulette apparatus (1) according to claim 1, wherein the roulette apparatus (1) is configured that the numbers on the display fields (12) of the display (11) are controlled by the control unit (40) to be fixed in relation to the roulette apparatus (1) or spinning with the roulette wheel (2) in the same turning direction or in the opposite turning direction.

9. A method to adjust a roulette wheel (2) of a roulette apparatus (1) according to claim 1, with the following steps:

a. One or more sensors of the sensor unit (20) detects one or more physical characteristics and/or a status parameter and/or a position related parameter of the roulette wheel (2);

b. a sensor of the sensor unit (20) detects the position of the ball (4) which is rested in one of the pockets (3) of the roulette wheel (2);

c. the control system (40) receives the information from the sensor unit (2) detected in step a) and b);

d. the control system (40) causes the drive unit (30) based on the received information to stop the roulette wheel (2) in a unambiguous calculated final position in relation to the display field (12) which shows the result of the roulette bet, wherein the pocket (3) with the ball (4) lies directly adjacent in congruence with the respective display field (12).

10. The method according to claim 9, wherein the control system calculates after step b) the possible unambiguous stop positions of the wheel and/or the positions where the wheel is not allowed to stop because of unambiguousness between the position of the pocket (3) within the ball (4) and the adjacent target display field (12).

11. The method according to claim 9, wherein the control system (40) and drive unit (30) manipulate the roulette wheel (2) in order to be adjusted to the calculated stop position, if the calculated stop position is deviated from the desired respective unambiguous stop position by a correction measure in order to bring the pocket (3) with the ball (4) clearly in accordance with a display field (12), which has been calculated as the target display field (12) of those display fields (12) adjacent to the final position of the pocket (3) with the ball (2), whereby the correction measure corrects the final stop position in regard to the respective display field (12) not more than the calculated deviation from this target display field.

12. The method according to claim 11, wherein the correction measure will be performed by an adjustment unit, in particular by a respective deceleration or acceleration measure with a respective calculated deceleration or acceleration value.

13. The method according to claim 9 wherein the apparatus (1) is provides with different selectable game modes and wherein a game controller is provided and the game controller comprises means to select a game mode and to display the respective game information on at least one display field (12) of the electronic display (11).

* * * * *